US006049266A

United States Patent [19]

Hoshino et al.

[11] Patent Number: 6,049,266

[45] Date of Patent: Apr. 11, 2000

[54] SINGLE-PHASE THREE-WIRE TYPE TRANSFORMER

[75] Inventors: Masahiro Hoshino; Hideaki Nagayoshi, both of Oyama, Japan

[73] Assignee: Takaoka Electric Mfg. Co., Ltd., Tokyo, Japan

[21] Appl. No.: 09/288,288

[22] Filed: Apr. 8, 1999

[30] Foreign Application Priority Data

Aug. 11, 1998 [JP] Japan ..... 10-226783

[51] Int. Cl.[7] ..... H01F 27/28

[52] U.S. Cl. ..... 336/180; 336/184; 336/186

[58] Field of Search ..... 336/145, 148, 336/170, 173, 180, 182, 18 R, 186

[56] References Cited

U.S. PATENT DOCUMENTS 3,579,165 5/1971 Johnson ..... 336/170

FOREIGN PATENT DOCUMENTS 254946 2/1988 European Pat. Off. .
0204225 11/1994 Japan .
936 050 6/1982 U.S.S.R. .

*Primary Examiner*—Anh Mai
*Attorney, Agent, or Firm*—Oblon, Spivak, McClelland, Maier & Neustadt, P.C.

[57] ABSTRACT

A single-phase three-wire type transformer which forms secondary coils by duplex coils winding two conductors in parallel according to the division intersection connection and can reduce currents circulating inside of a circuit of the transformer, thereby reducing the loss in the transformer. Coils A and B are formed in two opposing locations of a core (1). The coils A and B are configured so that two secondary coils and a primary coil are overlapped and wound in sequence from the inside of the core (1) in three layers, respectively. Each of the secondary coils provided by winding two conductors of small diameter in parallel condition on the core (1). One duplex coil connects the two parallel winding conductors in series with the other duplex coil, i.e. coils (211*a*) and (222*b*) are connected at a connection point (p), coils (212*a*) and (221*b*) at a connection point (q), coils (221*a*) and (212*b*) at a connection point (r), and coils (222*a*) and (211*b*) at a connection point (s), and the connection lines are intersected, whereby two closed circuits are formed in the secondary coils.

4 Claims, 7 Drawing Sheets

SINGLE-PHASE THREE-WIRE TYPE TRANSFORMER

BACKGROUND OF THE INVENTION

1. Field of the Invention

The present invention relates generally to a single-phase three-wire type transformer and, more particularly, to a single-phase three-wire type transformer in which a secondary coil is divided into a plurality of coils to be arranged in a core so that these coils are connected in an intersected condition in order to avoid an imbalance in the secondary voltage.

2. Description of the Background Art

Some single-phase three-wire type transformers have a structure so that a secondary coil is divided into a plurality of coils to avoid an imbalance in secondary voltages (due to a connection state of loads) to be arranged in a core so that these coils are connected in an intersected condition. Such single-phase three-wire type transformers are referred to as division intersection connections and generally have been widely used.

In other words, a single-phase three-wire type transformer adopting the division intersection connection, as shown in FIG. 4, includes a core 1 of an iron frame of an approximately square configuration, and conductors are wound opposite on two locations on the core 1, respectively, to form a coil A and coil B. However, these coils A and B are not merely an independent primary or secondary coil, respectively, but make up three-layer structures with three overlapped and wound coils, respectively, as shown in FIG. 5. The coil A is constituted so that secondary coils 21*a* and 22*a* and a primary coil 11*a* are overlapped and wound in sequence from the inside of the core 1. The coil B is similarly constituted so that secondary coils 21*b* and 22*b* and a primary coil 11*b* are overlapped and wound in sequence from the inside of the core 1. These connections are made so that the primary coils 11*a* and 11*b* are combined in series with the respective other ends of the coils to be set as primary terminals 1*a* and 1*b* in the primary coils. The secondary coils 21*a* and 22*b* are combined at a connection point 2*x* and the secondary coils 22*a* and 21*b* are connected at a connection point 2*y* to cause the connections to be intersected. Then, the other ends of the secondary coils 22*a* and 22*b* are combined to make this connection point a secondary terminal 2*n*, and the other end of the secondary coil 21*a* is made a secondary terminal 2*u* and also the other end of the secondary coil 21*b* is made a secondary terminal 2*v*.

When the connections are intersected in this way, when a load is connected only between the secondary terminals 2*u* and 2*n*, for example, an electric current will flow from the secondary terminal 2*u* through the secondary coils 21*a* and 22*b* to the secondary terminal 2*n*, so that an electric current can flow through both the coils A and B to maintain the balance of magnetic flux for the core 1, resulting in equilibrium of the voltage.

In addition, in order to increase the electric current capacity in the secondary coils, it is necessary to adopt a thick winding conductor with an increased cross-sectional area for the winding conductor of the secondary coils 21*a*, 22*a*, 21*b*, and 22*b*. However, when the diameter of the winding conductor is made large, there may arise a disadvantage in which eddy current loss may become large, causing the conversion efficiency of the transformer to be decreased. Therefore, each secondary coil is made double by winding two parallel winding conductors of small diameter on the core 1, and secondary coils are constituted by connecting each doubled secondary coil in an intersecting condition. That is, as shown in FIG. 6, the secondary coil 21*a* has a duplex structure of coils 211*a* and 212*a* made by winding two parallel winding conductors of small diameter. Similarly, the secondary coils 22*a*, 21*b*, and 22*b* have a duplex structure of coils 221*a* and 222*a*, coils 211*b* and 212*b*, and coils 221*b* and 222*b*, respectively. Furthermore, these duplex coils are connected in parallel by combining the respective lead portions extending from the ends of the duplex coils. As for the combinations between the coils, as discussed hereinbefore, the secondary coils 21*a* and 22*b* are combined at the connection point 2*x* and the secondary coils 22*a* and 21*b* are connected at the connection point 2*y* causing the connections to be intersected. Then, the other ends of the secondary coils 22*a* and 22*b* are combined to make this connection point to be the secondary terminal 2*n*, and another end of the secondary coil 21*a* is made the secondary terminal 2*u*, and the other end of the secondary coil 21*a* is made the secondary terminal 2*v*.

In this case, although the diameter of the winding conductor is small, each secondary coil has a duplex structure, so that the electric current capacity is increased substantially to double that of a conductor with a small diameter, and because the diameter of the winding conductor is small, the eddy current loss can be suppressed to a low level.

However, a single-phase three-wire type transformer of the prior art described above has a disadvantage inasmuch as when each secondary coil is configured with a duplex structure, four closed circuits are formed among the secondary terminals 2*n*, 2*u*, and 2*v* and connection points 2*x* and 2*y* of the intersection connections so that circulating currents according to electromotive forces originating from the distribution of magnetic flux density may flow through these closed circuits, resulting in a loss W.

That is, among the secondary terminals 2*n*, 2*u*, and 2*v* and connection points 2*x* and 2*y* of the intersection connections, there are formed a closed circuit C1 with a current circulating through the secondary terminal 2*u*, coil 211*a*, connection point 2*x*, coil 212*a*, and the secondary terminal 2*u*, a closed circuit C2 with a current circulating through the secondary terminal 2*n*, coil 222*b*, connection point 2*v*, coil 212*b*, and the secondary terminal 2*n*, a closed circuit C3 with a current circulating through the secondary terminal 2*v*, coil 212*b*, connection point 2*y*, coil 211*b*, and the secondary terminal 2*v*, and a closed circuit C4 with a current circulating through the secondary terminal 2*n*, coil 221*a*, connection point 2*y*, coil 222*a*, and the secondary terminal 2*n*.

Furthermore, there is, of course, a magnetic field (a leakage magnetic flux) outside the core 1 in this transformer. The distribution of the magnetic flux density will be described using FIG. 2 according to the present invention. The magnetic flux density reaches a peak value on an interface of the primary and secondary coils, as shown in FIG. 2, and the electromotive force (V) is generated in proportion to this magnetic flux density (B), so that the circulating current flows in each closed circuit. When the peak value of the electromotive force is assumed to be V, as the secondary coils 21*a* and 22*a* are composed of four layers, so the respective electromotive forces among each of the layers become (¼)V between layers 1 and 2, (⅔)V between layers 2 and 3, and (¾)V between layers 3 and 4. Similarly, as the secondary coils 21*b* and 22*b* are composed of four layers, so the respective electromotive forces among each of the layers become (¼)V between layers 1 and 2, (⅔)V between layers 2 and 3, and (¾)V between layers 3 and 4.

Therefore, as shown in FIG. 7, circulating currents may flow based on the electromotive forces generated among each of the layers of the secondary coils in each of the closed circuits, and when the resistance component of each closed circuit is assumed to be R, the loss in the closed circuit C1 will become $|(1/4)V|^2/R$, similarly, the loss in the closed circuit C2 will become $|(3/4)V|^2/R$, the loss in the closed circuit C3 will become $|(1/4)V|^2/R$, and the loss in the closed circuit C4 will become $|(3/4)V|^2/R$. Therefore, the loss W in this transformer will become the sum of each loss described above, i.e., $(5/4)\times(V^2/R)$ Incidentally, the resistance components of each closed circuit are equivalent to a resistor value generated when two coils constituting a duplex coil are connected in parallel, and the resistor value of a winding conductor itself of a coil is so small that the variation of resistor values among the coils so completed is very small. Consequently, all of the resistor values may be considered to be the same value.

The present invention has been made in view of the above-described background, and therefore, has objects to solve the above-described problems, to enable the induced magnetic flux to be balanced on the magnetic path regardless of the connection condition according to the division intersection connection, and also to enable the electric current circulating through the inside of a circuit of a transformer to be reduced even when secondary coils are formed with a duplex coil configured by winding two conductors in parallel, thereby providing a single-phase three-wire type transformer which can reduce the loss in the coils.

SUMMARY OF THE INVENTION

In order to achieve the above-mentioned objects, a single-phase three-wire type transformer according to the present invention in which a secondary coil is divided into four to arrange each of two coils at two locations on a core in two-layer structure and two layers of an inner layer and outer layer are connected in an intersecting condition at two locations between both arrangement locations in order to avoid an imbalances in secondary voltages is characterized in that each of the secondary coils divided into four is made into a duplex coil by winding two conductors in parallel onto the core and, when connecting said two layers in said intersecting condition, two parallel winding conductors of the one duplex coil are connected in series respectively with those of the other duplex coil.

Therefore, the secondary coil according to the present invention is formed by duplex coils with two conductors wound in parallel, and the intersecting connection for one duplex coil is connected in series with the other duplex coil, so that the secondary side of the transformer forms an intersecting connection of duplex structure when viewed from the secondary terminals. In this case, each of the connection points for the intersecting connection is independent electrically without contacting another connection point, so that only two closed circuits are formed. This number is half of that of a conventional transformer described above.

Moreover, circulating currents based on the electromotive forces originating from the distribution of magnetic flux density will flow through each of the closed circuits. However, as the coils of each closed circuit are disposed dispersedly in two locations in the core and the directions of the electromotive forces (the circulating currents) of each closed circuit are made the reverse of the other, the circulating currents are canceled each other so as to be decreased and these currents flow from the high potential side toward the low potential one.

Other and further objects, features and advantages of the present invention will appear more fully from the following description.

DETAILED DESCRIPTION OF THE INVENTION AND PREFERRED EMBODIMENTS

Figure 1:
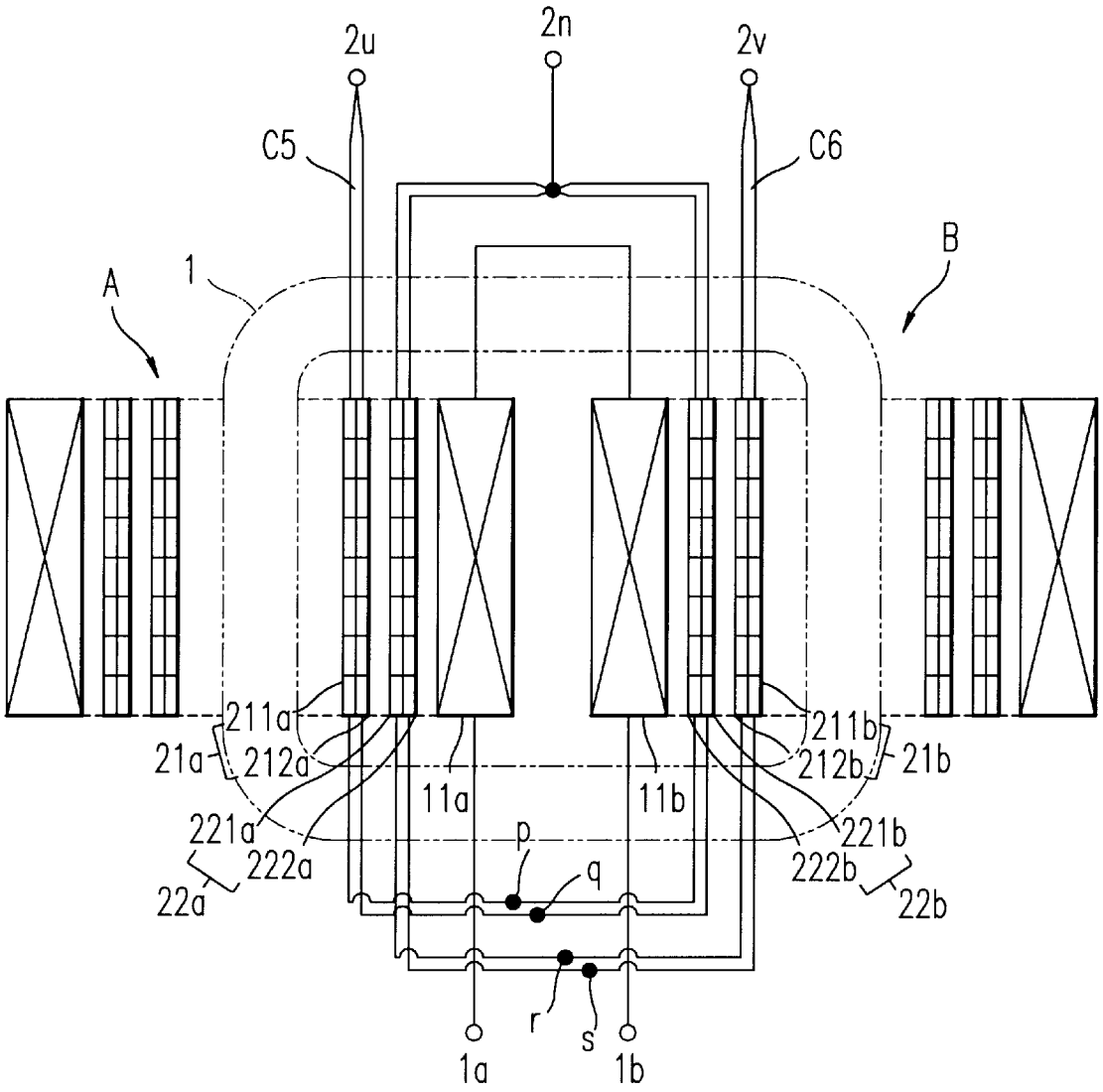
FIG. 1 is a schematic diagram of a single-phase three-wire type transformer of one embodiment according to the present invention.
Figure 4:
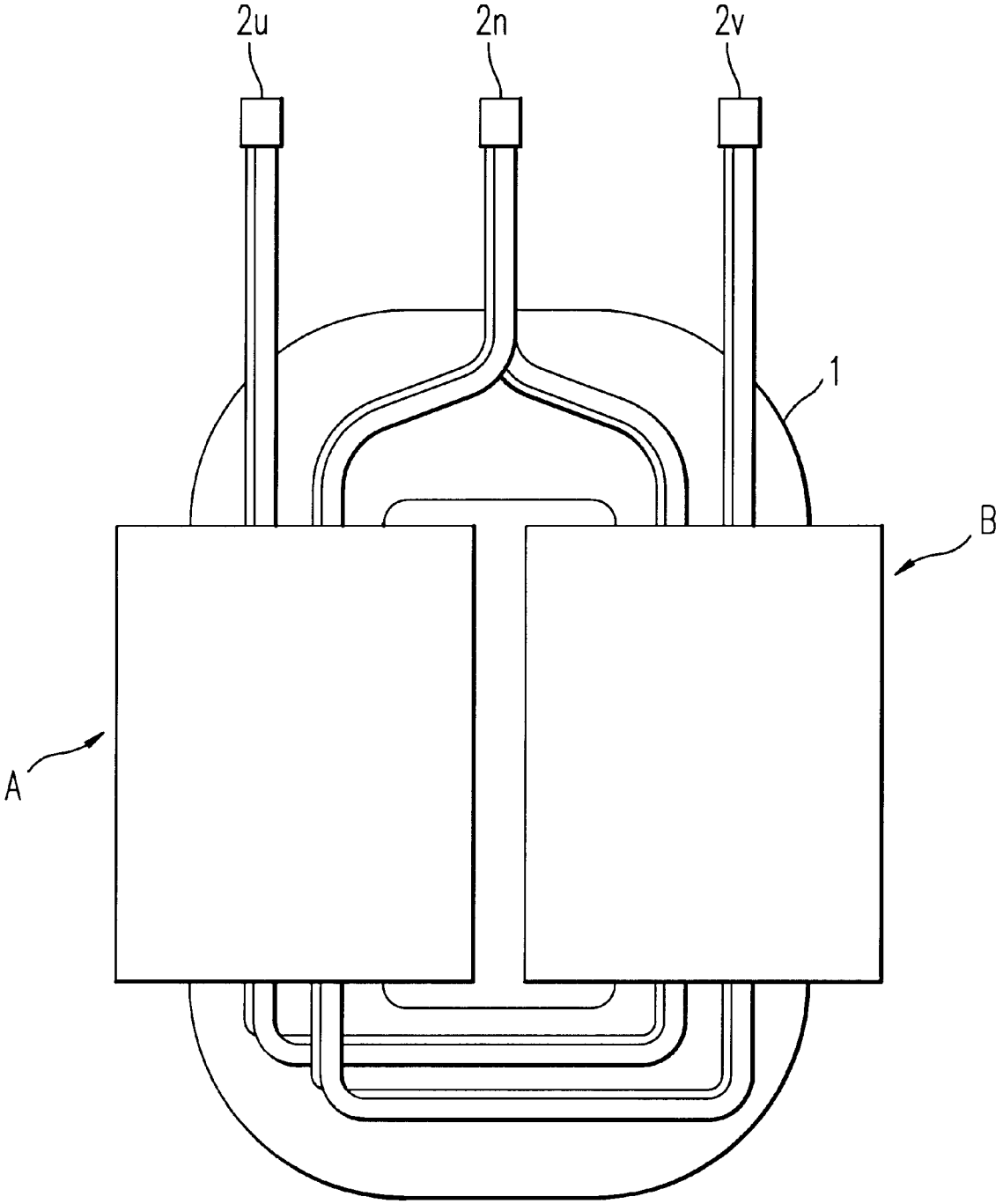
FIG. 4 PRIOR ART
FIG. 4 is a front view of a conventional single-phase three-wire type transformer.
Figure 5:
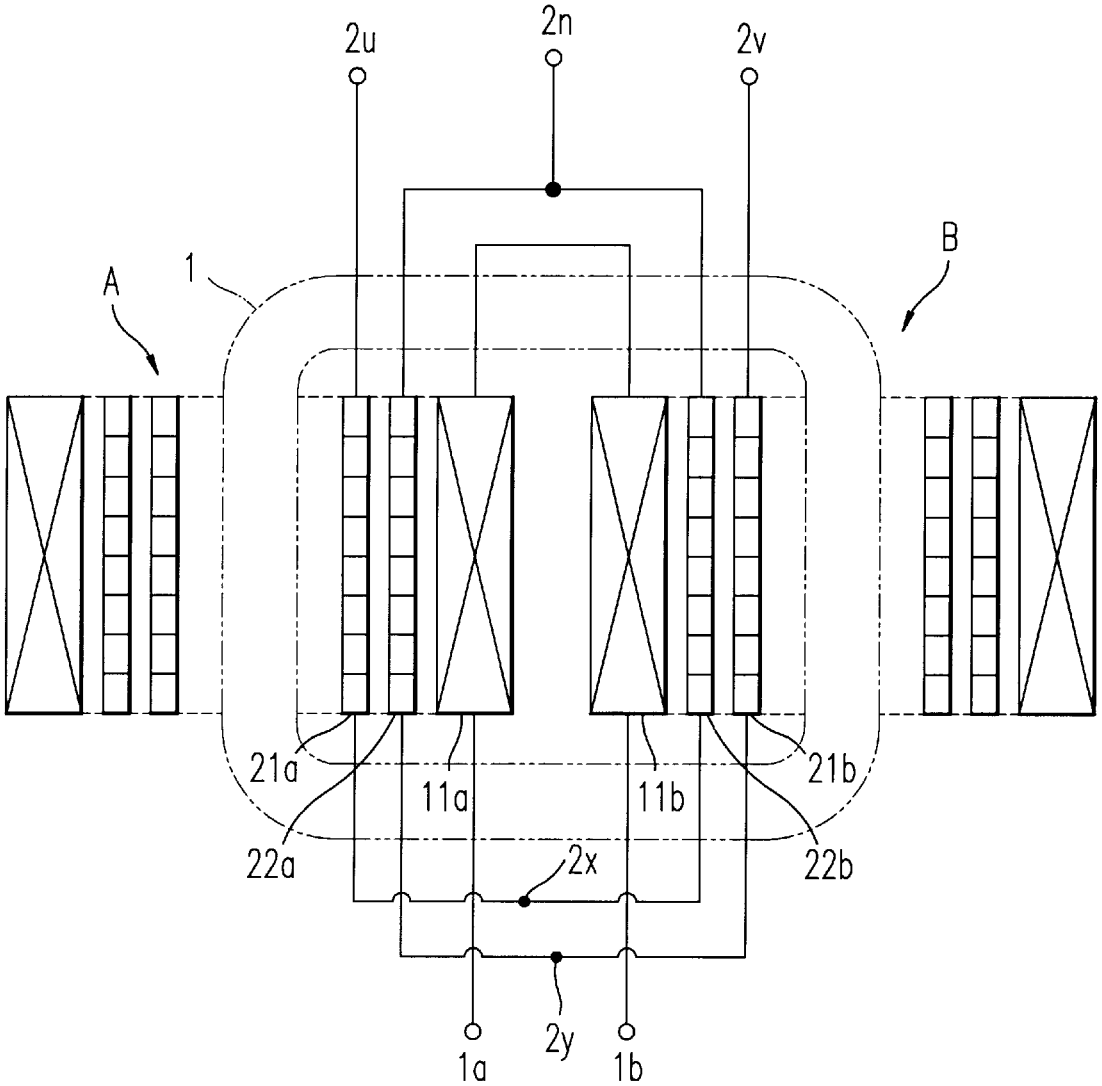
FIG. 5 PRIOR ART
FIG. 5 is a schematic diagram of a single-phase three-wire type transformer of the prior art.
Figure 6:
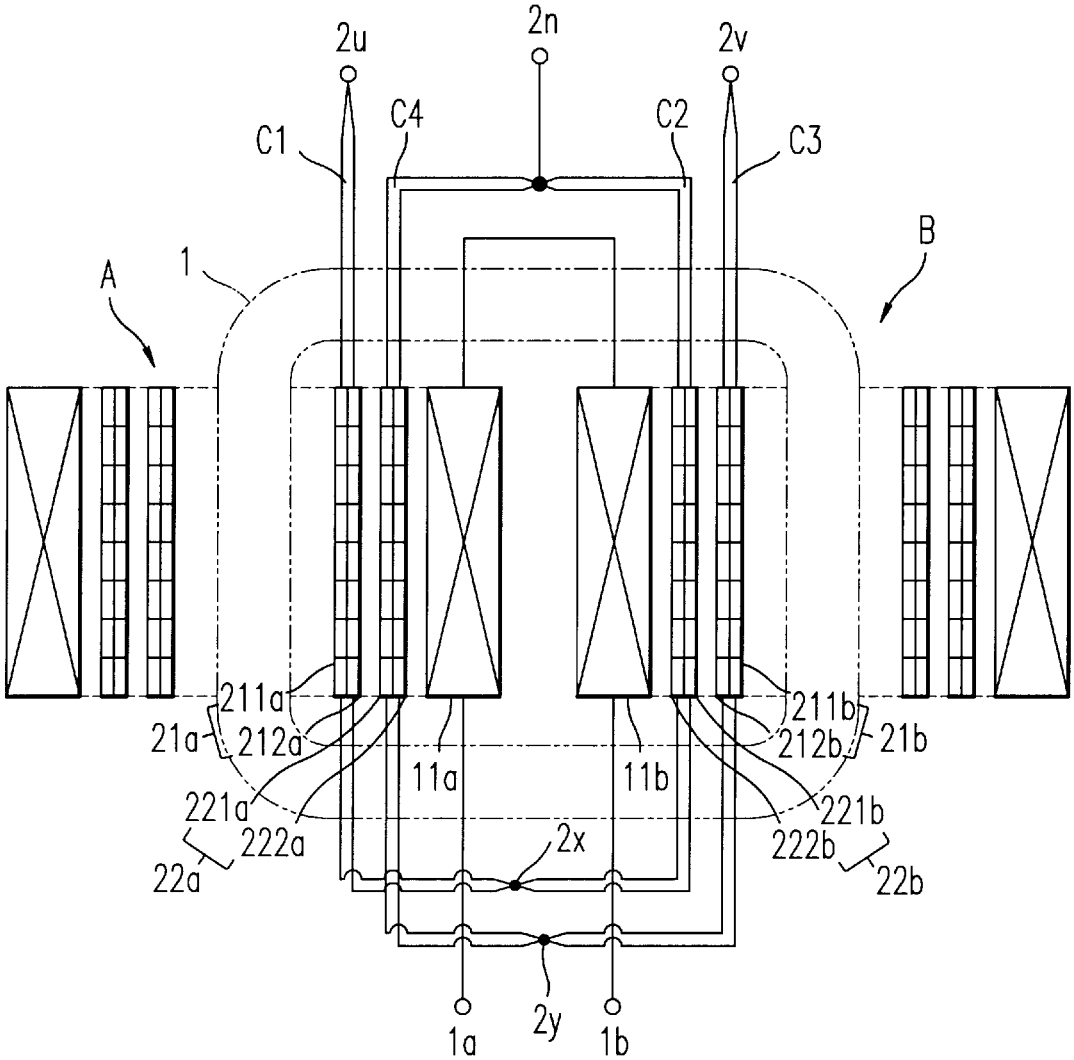
FIG. 6 PRIOR ART
FIG. 6 is a schematic diagram of another single-phase three-wire type transformer of the prior art.
Figure 7:
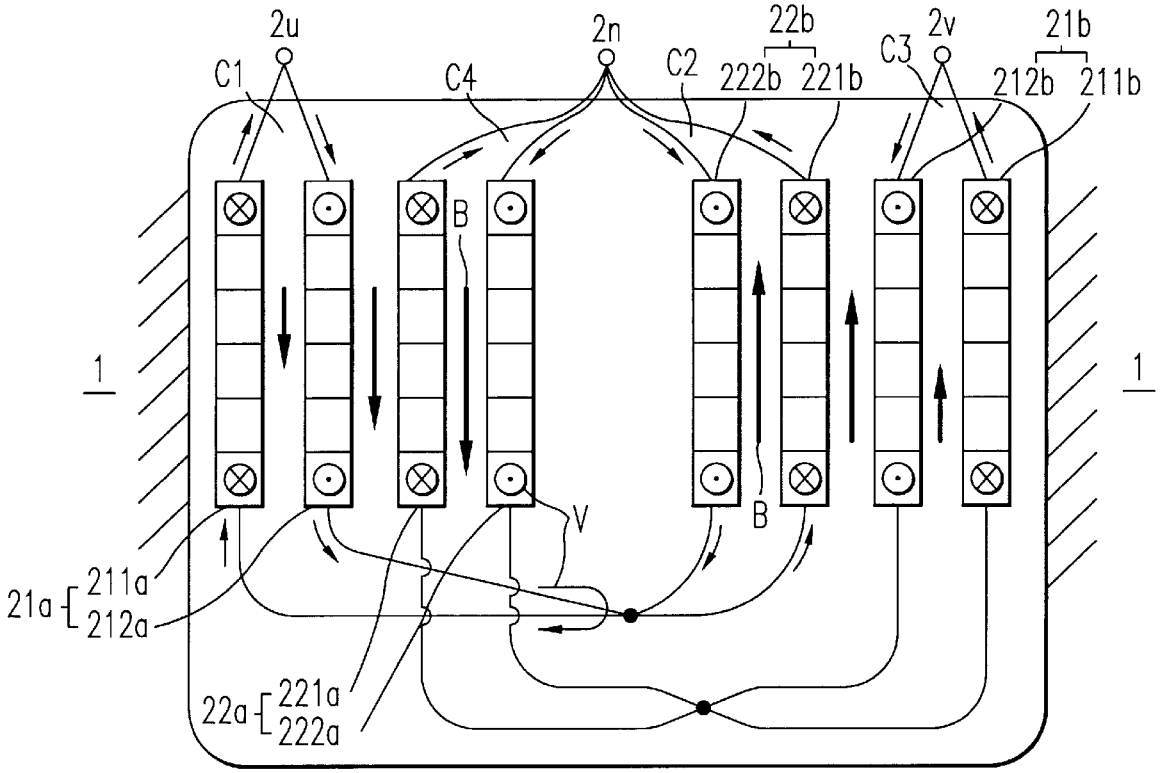
FIG. 7 PRIOR ART
FIG. 7 is a schematic diagram showing circulating currents of the secondary coils in the single-phase three-wire type transformer of FIG. 6.

FIG. 1 is a schematic diagram of a single-phase three-wire type transformer of one embodiment according to the present invention. The single-phase three-wire type transformer, similar in appearance to the conventional example shown in FIG. 4, includes a core 1 made of an iron frame of approximately square configuration. Conductors are wound on two opposing locations of the core 1, to form a coil A and coil B, respectively.

These coils A and B make up three-layer structures with three overlapped and wound coils, respectively. The coil A is constituted so that secondary coils 21*a* and 22*a* and a primary coil 11*a* are overlapped and wound in sequence from the inside of the core 1. The coil B is similarly constituted so that secondary coils 21*b* and 22*b* and a primary coil 11*b* are overlapped and wound in sequence from the inside of the core 1. These connections are made so that the primary coils 11*a* and 11*b* are combined in series with the respective opposite ends of the coils act as primary terminals 1*a* and 1*b* in the primary coils.

The secondary coils 21*a*, 22*a*, 21*b*, and 22*b* adopt a duplex coil configuration. That is, two winding conductors of small diameter are wound on the core 1 in parallel, and the secondary coil 21*a* has a duplex structure of coils 211*a* and 212*a*. Similarly, the secondary coils 22*a*, 21*b*, and 22*b* have a duplex structure of coils 221*a* and 222*a*, coils 211*b* and 212*b*, and coils 221*b* and 222*b*, respectively.

These duplex coils are configured so that two parallel winding conductors are connected in series, that is, as for the combinations between duplex coils, each one end of the coils 211*a* and 222*b* is combined at the connection point p, each one end of the coils 212*a* and 221*b* at the connection point q, each one end of the coils 221*a* and 212*b* at the connection point r, and each one end of the coils 222*a* and 211*b* at the connection points to cause the connections to be intersected. Moreover, all of the other ends of the coils 221*a* and 222*a* and coils 221*b* and 222*b* in outer layers are combined to make this connection point a secondary terminal 2*n*, and the other ends of the coils 211*a* and 212*a* of one inner layer are connected at the conductor portion of their lead wires to make the connection point a secondary terminal 2*u*. Similarly, the other ends of the coils 211*b* and 212*b* of the other inner layer are connected at the conductor portion of their lead wires to make the connection point a secondary terminal 2*v*.

By adopting such a configuration, the secondary side of the transformer configures intersecting connections of duplex structure when viewed from the secondary terminals 2*n*, 2*u*, and 2*v*, and each of the connection points p, q, r, and s is independent electrically without contacting any of the other connection points, so that only two closed circuits are formed. Therefore, there is formed a closed circuit C5 with a current circulating through the secondary terminal 2*u*, coil 211*a*, connection point p, coil 222*b*, secondary terminal 2*n*, coil 221*b*, connection point q, coil 212*a*, and secondary terminal 2*u* between the secondary terminals 2*u* and 2*n*, and a closed circuit C6 with a current circulating through the secondary terminal 2*v*, coil 211*b*, connection point s, coil 222*a*, secondary terminal 2*n*, coil 221*a*, connection point r, coil 212*b*, and secondary terminal 2*v* between the secondary terminals 2*v* and 2*n*.

Figure 2:
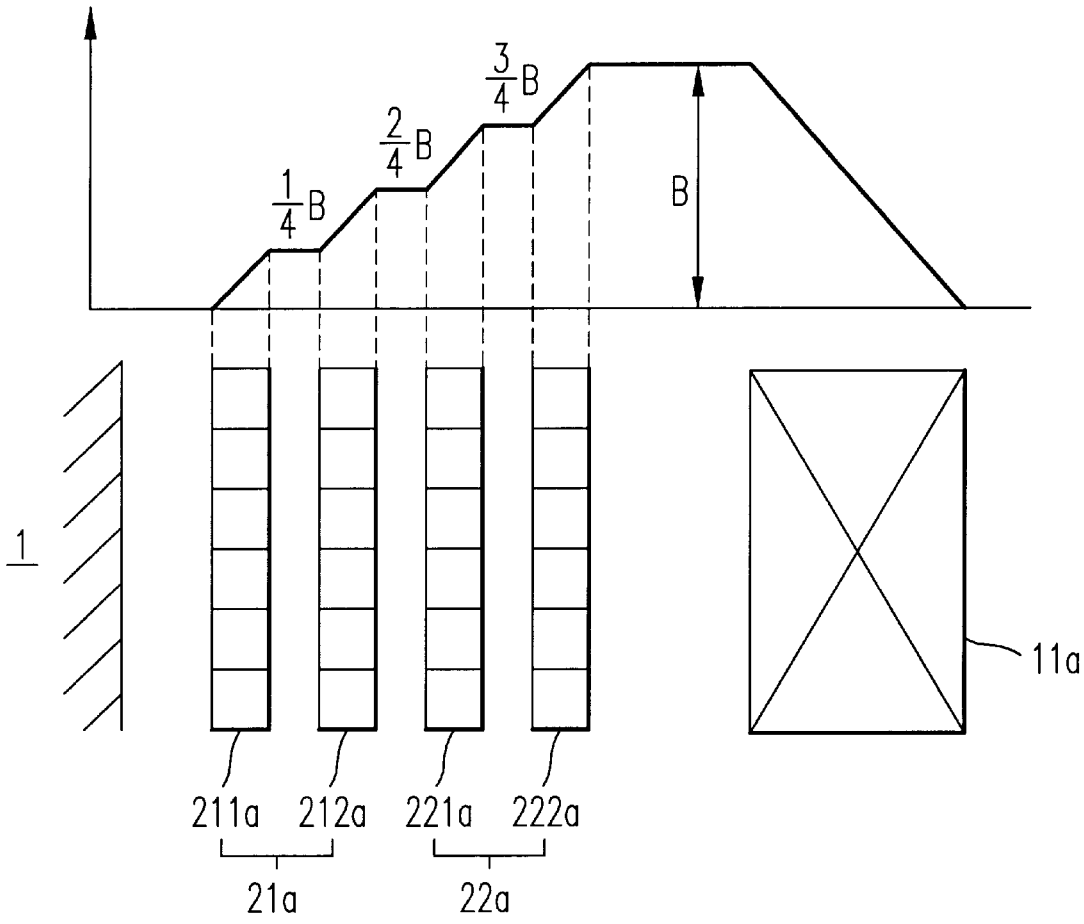
FIG. 2 is a graphical representation showing the distribution of the magnetic flux density in the single-phase three-wire type transformer of FIG. 1.

Furthermore, there is, of course, a magnetic field (a leakage magnetic flux) outside of the core 1 in this transformer. The distribution of magnetic flux density reaches a peak value on an interface of the primary and secondary coils, as shown in FIG. 2, and an electromotive force (V) will be generated in proportion to this magnetic flux density (B). When the peak value of the electromotive force is assumed to be V, as the secondary coils 21*a* and 22*a* are composed of four layers, therefore the respective electromotive forces among each of the layers become (¼)V between layers 1 and 2, (⅔)V between layers 2 and 3, and (¾)V between layers 3 and 4. Similarly, as the secondary coils 21*b* and 22*b* are composed of four layers, therefore the respective electromotive forces among each of the layers become (¼)V between layers 1 and 2, (⅔)V between layers 2 and 3, and (¾)V between layers 3 and 4.

Figure 3:
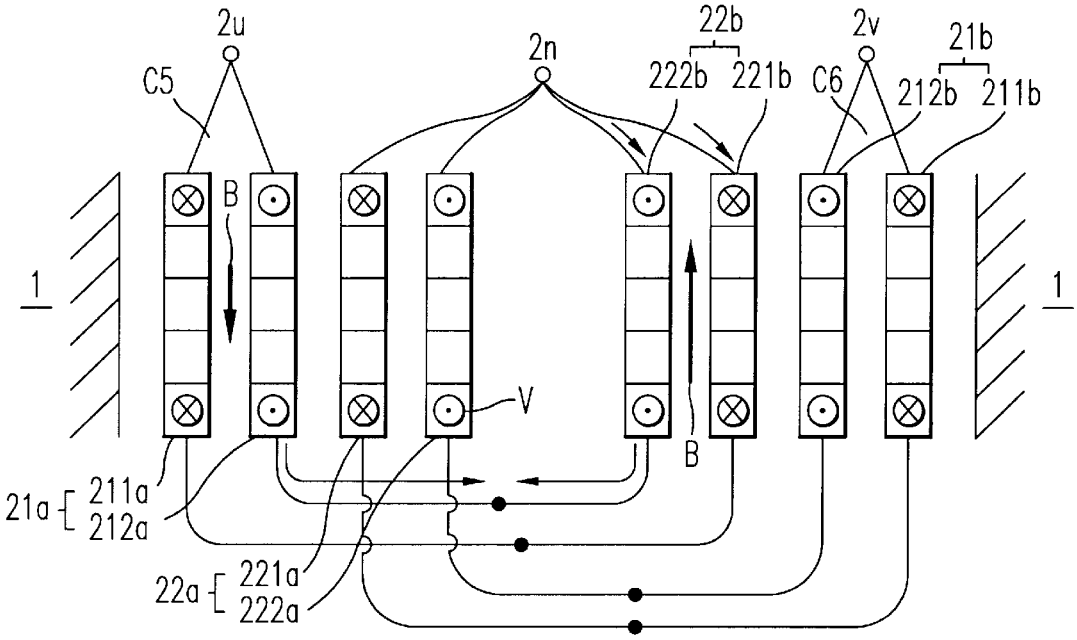
FIG. 3 is an explanatory view showing circulating currents of the secondary coils in the single-phase three-wire type transformer of FIG. 1.

Hence, circulating currents based on the electromotive forces among each of the layers of the secondary coils will flow in each closed circuit, as shown in FIG. 3. However, as the directions of the electromotive forces (the circulating current) are reversed in the coils A and B, the circulating currents cancele each other so that they decrease, and they flow from the high potential side toward the low potential one. That is, the electromotive force (¼)V between layers 1 and 2 of the secondary coils 21*a* and 22*a* is subtracted from the electromotive force (¾)V between layers 3 and 4 of the secondary coils 21*b* and 22*b* in the closed circuit C5. Also, the electromotive force (¼)V between layers 1 and 2 of the secondary coils 21*b* and 22*b* is subtracted from the electromotive force (¾)V between layers 3 and 4 of the secondary coils 21*a* and 22*a* in the closed circuit C6. Then, when a resistance component of each of the closed circuits C1, C2, C3, and C4 described above is assumed to be R, the resistance component in these closed circuits C5 and C6 becomes 2R, so that the loss in the closed circuit C5 will become $|(3/4)V-(1/4)V|^2/2R$. Similarly, a loss in the closed circuit C6 will become $|(3/4)V-(1/4)V|^2/2R$. Therefore, the loss W in this transformer will become the sum of each loss previously described, i.e., $(1/4)\times(V^2/R)$.

In this manner, the single-phase three-wire type transformer according to the present invention is configured so that the intersecting connection for one duplex coil is connected in series with the other duplex coil, so that two closed circuits are formed, corresponding to half of the conventional transformer previously described. In addition, although circulating currents based on the electromotive forces originating from the distribution of magnetic flux density will flow in each of the closed circuits C5 and C6, the directions of the electromotive forces (the circulating currents) are mutually reversed in coils A and B, so that the electromotive forces will be canceled between the two coils, allowing the circulating currents to be reduced. As a result, the loss W will become $(1/4)\times(V^2/R)$ as previously described, one fifth of that of the above-described conventional transformer.

Furthermore, the single-phase three-wire type transformer according to the present invention can be by simply connecting the two lead portions of thin winding conductors at each of the connection points p, q, r, and s of the secondary coils. Because the number of the thin winding conductors connected is half that of the conventional transform, crimp contacts of a small size can be used and a small and light application tool can be utilized, allowing the manufacturing work to be facilitated. Additionally, this pressure work requires only bending the lead portions of a thin winding conductor one by one to form the connection points, so that the connection points can be easily formed using a low power, resulting in excellent workability.

As is apparent from the above explanation, the single-phase three-wire type transformer according to the present invention can achieve the effect of reducing loss in addition to enabling the induced magnetic flux to be balanced on the magnetic path regardless of the connection condition according to the division intersection connection. That is, the intersecting connection for one duplex coil constituting a secondary coil is connected in series with the other duplex coil, so that the secondary side of the transformer is caused to be the intersecting connection of the duplex configuration when viewed from the secondary terminal. Thus only two closed circuits are formed (this number corresponds to half of that of the conventional transformer described above). Although circulating currents based on the electromotive forces originating from the distribution of magnetic flux density will flow through each closed circuit, the coils of each closed circuit are arranged dispersedly in two locations on the core and the directions of the electromotive forces (circulating currents) are reversed, so that the electromotive forces are canceled between the two closed circuits to reduce the circulating currents. The circulating currents will flow from the high potential side toward the low potential side. Accordingly, the current circulating through inside of the circuit of the transformer can be reduced, thereby achieving an excellent effect in reducing the loss in the transformer.

Obviously, numerous modifications and variations of the present invention are possible in light of the above teachings. It is therefore to be understood that within the scope of the appended claims, the invention may be practiced otherwise than as specifically described herein.

What is claimed is:

1. A single-phase three-wire transformer comprising:

a core;

a first coil wrapped around a first portion of the core, said first coil including a first secondary coil having a duplex structure and including a first winding and a second winding, and a second secondary coil having a duplex structure and including a third winding and a fourth winding, said first secondary coil being wound inside of said second secondary coil relative to said core; and a second coil wrapped around a second portion of the core, said second coil including a third secondary coil having a duplex structure and including a fifth winding and a sixth winding, and a fourth secondary coil having a duplex structure and including a seventh winding and an eighth winding, said third secondary coil being wound inside of said fourth secondary coil relative to said core, wherein said first winding is connected in series to said eighth winding, said second winding is connected in series to said seventh winding, said third winding is connected in series to said sixth winding, and said fourth winding is connected in series to said fifth winding.

2. The transformer of claim 1, wherein the first coil comprises a first primary coil, and the second coil comprises a second primary coil, said first and second primary coils having respective first ends connected in series and having respective second ends forming first and second primary terminals, respectively.

3. The transformer of claim 1, wherein said first and second windings are connected to form a first secondary terminal, said third, fourth, seventh, and eighth windings are connected to form a second secondary terminal, and said fifth and sixth windings are connected to form a third secondary terminal.

4. The transformer of claim 3, wherein the first coil comprises a first primary coil, and the second coil comprises a second primary coil, said first and second primary coils having respective first ends connected in series and having respective second ends forming first and second primary terminals, respectively.

* * * * *